US007262547B2

(12) United States Patent
Klett et al.

(10) Patent No.: US 7,262,547 B2
(45) Date of Patent: Aug. 28, 2007

(54) SPARK PLUG ELEMENT HAVING DEFINED DIMENSIONAL PARAMETERS FOR ITS INSULATOR COMPONENT

(75) Inventors: Dittmar Klett, Pleidelsheim (DE); Thomas Kaiser, Stuttgart (DE); Dirk Scholz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 171 days.

(21) Appl. No.: 10/925,015

(22) Filed: Aug. 23, 2004

(65) Prior Publication Data

US 2005/0052107 A1 Mar. 10, 2005

(30) Foreign Application Priority Data

Aug. 28, 2003 (DE) ..... 103 40 043

(51) Int. Cl.
*H01T 13/20* (2006.01)
*H01T 13/00* (2006.01)

(52) U.S. Cl. ..... 313/143; 313/141; 313/144; 313/145

(58) Field of Classification Search ..... 313/140–145
See application file for complete search history.

(56) References Cited

U.S. PATENT DOCUMENTS 5,239,225 A * 8/1993 Moriya et al. ..... 313/143
5,929,556 A * 7/1999 Matsubara et al. ..... 313/141
6,316,868 B1 * 11/2001 Ishino et al. ..... 313/141
6,552,476 B1 * 4/2003 Hanashi et al. ..... 313/141
2002/0079800 A1 * 6/2002 Miyashita et al. ..... 313/143
2003/0001474 A1 * 1/2003 Teramura et al. ..... 313/141
2003/0085643 A1 * 5/2003 Matsubara ..... 313/141

FOREIGN PATENT DOCUMENTS

DE 2 106 893 8/1972
GB 1 373 435 11/1974

* cited by examiner

*Primary Examiner*—Mariceli Santiago
(74) *Attorney, Agent, or Firm*—Kenyon & Kenyon LLP

(57) ABSTRACT

A spark plug which includes an end at its combustion chamber end, and an end at its connecting end, as well as a housing and an insulator situated in the housing. The insulator has a longitudinal bore having a longitudinal axis, a center electrode situated in the longitudinal bore of the insulator, a first ground electrode which extends into the region of the longitudinal axis of the insulator, and a second ground electrode which is situated at a distance from the longitudinal axis of the insulator laterally next to the center electrode. The insulator has a front section, facing the first ground electrode, which has an end face. The insulator has an outside diameter d and an inside diameter c, d–c, that is, the difference between outside diameter d and inside diameter c, in the front section of the insulator being not greater than 1.9 mm.

57 Claims, 4 Drawing Sheets

SPARK PLUG ELEMENT HAVING DEFINED DIMENSIONAL PARAMETERS FOR ITS INSULATOR COMPONENT

FIELD OF THE INVENTION

The present invention relates to a spark plug.

BACKGROUND INFORMATION

A spark plug is described in German Patent No. 2106 893 A1, for instance. The spark plug has a housing in which there is an insulator. A longitudinal bore has been put into the insulator in which a center electrode is situated. Three ground electrodes are fixed to the housing, one of the side electrodes being designed as a top electrode and the other two side electrodes as laterally placed electrodes. By the application of an ignition voltage, a spark gap forms between the center electrode and one of the side electrodes. The spark gap between the top electrode and the center electrode runs along a longitudinal axis of the longitudinal bore of the insulator (spark air gap). Between the laterally placed electrodes and the center electrode, a surface gap forms, which runs over the end face of the insulator facing the combustion chamber. The center electrode is situated fitting precisely into the longitudinal bore of the insulator, or has only a slight distance from the insulator. Such spark plugs, in which, because of the electrode geometry, both a spark air gap and a surface gap (or rather a surface air gap) are able to form, are used particularly in applications in which strong carbon fouling of the insulator may occur. This is the case, for example, during use in stratified-charge engines. Because of the spark discharge via the surface gap, the soot on the surface of the insulator is at least partially combusted.

What is disadvantageous about this is that soot deposits on the insulator at the start of the internal combustion engine, since the insulator is heated up only slowly during the starting process.

Because of a carbon-fouled surface of the insulator, a so-called sliding discharge, that is, a discharge between housing and insulator, is favored specifically in the starting phase, since, during the starting phase, particularly high ignition voltages are present because of a lower intake-manifold vacuum, later ignition and lower intake temperature. Such a sliding discharge may lead to problems during ignition of the air/fuel mixture in the combustion chamber and may also cause ignition misfiring.

SUMMARY

An example spark plug according to the present invention may have the advantage that the insulator is quickly heated up during a starting phase, so that soot deposits in the starting phase are greatly reduced.

For this purpose, it is provided that the insulator has an external diameter d and an internal diameter c in a front section facing the ground electrode, and that d−c is not greater than 1.9 mm. Starting from an end face of the insulator facing the first ground electrode, the front region extends in the direction of the connecting end of the spark plug. The front section of the insulator has an axial length p, the extension in the direction of the longitudinal axis of the insulator being understood as being the axial length. If $d-c \leqq 1.9$ mm (d−c being exactly twice the wall thickness of the front section of the insulator), the insulator is quickly heated up, since a body having a lesser wall thickness is heated up more rapidly.

The heat transfer between the hot gases located in the combustion chamber and the insulator takes place predominantly in the front section of the insulator that extends from the housing, since, in this section, the flow speeds and strong vorticities of the hot gases are particularly great, and since the heat transfer is particularly great at high flow speeds and strong turbulences.

An example geometry of the front section of the insulator has proven particularly advantageous for the heating behavior, in which d−c is in the range of 1.6 mm to 1.8 mm, and/or in which c is in the range of 2.6 mm to 3.0 mm, and/or in which d is in the range of 4.3 mm to 4.7 mm, especially in the range of 4.4 mm to 4.6 mm.

The front section of the insulator, beginning at its end face, extends to a plane perpendicular to the longitudinal axis of the insulator, which is at a distance p from the end face. Thus, the front section has a volume V, an outer surface A and an annular surface R. Outer surface A is composed of the outer and inner lateral surface and the end face of the front section of the insulator, the transition between the lateral surfaces and the end face may be configured, for example, by rounded edges or by conically running-in regions, and naturally, in just the same way contributes to outer surface A. Annular surface R is the surface within the insulator, which is in the plane, mentioned above, that is perpendicular to the longitudinal axis of the insulator, and by whose front region the insulator is bounded.

In order to avoid the soot deposits during a cold start, furthermore, advantageously a geometry of the front section of the insulator is provided in which the quotient of volume V and outer surface A of the front section is less than 0.33 mm, particularly within the range of 0.20 mm to 0.32 mm. The heating of the front section of the insulator during cold starts takes place the quicker, the smaller is the volume V to be heated, and the greater the heat-absorbing outer surface A. A particularly good heating behavior, at simultaneously low wear on the end face of the ceramics by sparks digging in, was achieved by a spark plug having a ratio V/A in the range of 0.23 mm to 0.28 mm, particularly at 0.25 mm.

The region of the insulator in which the flow speeds and vorticities of the hot gas are particularly great, and thus the heat transfer to the insulator is especially great, is the region that extends from the housing on the combustion chamber side. Therefore, the length p, by which the axial length of the front section of the insulator is characterized, is advantageously given by the projection q of the insulator beyond the end of the housing on the combustion chamber side. Advantageously, q is between 2 mm and 3.5 mm.

Spark plugs having a first ground electrode designed as a top electrode and having (at least) a second ground electrode, which is put laterally next to the center electrode, form both spark air gaps (to the top electrode) and surface gaps or air surface gaps (to the laterally placed ground electrodes). The deposits on the insulator, via which otherwise undesired creeping currents or even discharges could flow, are burnt off by the air surface gaps. Such spark plugs are preferably used for engine concepts in which deposits, especially carbon fouling, occur repeatedly. An example for this is the stratified-charge engine, in which, in stratified operation, because of the late fuel injection, liquid fuel may still be present in the combustion chamber, which leads to increased soot formation during combustion.

Generally, such spark plugs are designed so that the majority of the discharges take place to the top electrode, and that the spark air gap between the top electrode and the center electrode leads to the optimal ignition of the air/fuel mixture, since the flame development (flame core) takes place at a specified location, whereby a uniform burn-through of the air/fuel mixture is ensured. This is especially important in stratified-charge engines. The voltage required for generating an optimum spark air gap is, however, relatively high, so that even laterally, at the outer surface of the insulator, high field strengths are present, by which free charge carriers are generated on a contaminated (e.g., carbon-fouled) surface of the insulator. The field configuration is changed by a gap provided between the second section of the center electrode and the insulator in such a way that the electrical field strength on the outside of the insulator is reduced. Thereby the number of movable charge carriers is reduced, and with that also the probability of a sliding discharge along the insulator to the housing. Therefore, advantageously the center electrode has a first and a second section, the first section having a radial distance from the longitudinal bore of the insulator of less than 0.15 mm, and the second section having a radial distance from the longitudinal bore of at least 0.15 mm. Because of the gap between the second section of the center electrode and the insulator, the field strength is reduced in the area of the surface of the insulator, and with that, the tendency to sliding discharges.

Particularly advantageously, the preponderant part of the second section of the center electrode has a radial distance from the longitudinal bore of at least 0.3 mm, in order to avoid especially effectively the generation of charge carriers on the outer surface of the insulator. The second section may be formed as a cylinder having, for instance, a conical transition region between the first and the second section of the center electrode. The transition region between the first and the second section may also be formed as a shoulder, whose surface lies in a plane that is perpendicular to the longitudinal axis of the insulator. Alternatively, the second section may be subdivided into various regions tapering in the direction of the first ground electrode so as to have decreasing diameters, a center electrode having such a tapering end section advantageously having a noble metal tip.

Advantageously, the axial extension h of the region, situated within the insulator, of the second section of the center electrode, is in the range of 0.3 mm to 2.0 mm, especially in the range of 0.5 mm to 1.4 mm, preferably 0.7 mm. Just as advantageously, the axial extension h is greater than a distance f, the distance f being the axial distance between the end face of the insulator and the side of the end section of the second ground electrode facing away from the first ground electrode.

In spark plugs whose center electrodes have a gap in the second section from the insulator, the length p of the front region of the insulator is advantageously given by the axial extension h of the region of the second section of the center electrode that is situated within the insulator, i.e., the insulator has, at least in that region, the advantageous geometry with respect to heating up that was described above, in which the center electrode has a comparatively large distance of its second section from the insulator. For, on account of the gap between the insulator and the second section of the center electrode, the heating up of the insulator is additionally promoted, since the hot gas is better able to reach the inner surface area of the insulator, so that a good heat transfer also takes place in the region of the inner surface area.

The heat created in the combustion chamber on account of the combustion of the air/fuel mixture leads to a strong heating of the end section of the spark plug on the combustion chamber side. In order to avoid overheating the spark plug, the spark plug is advantageously designed so that the heat of the end section of the spark plug on the combustion chamber side all the way to the connecting end of the spark plug is conducted away. If the insulator is at only a very short distance from the first section of the center electrode, then the major portion of the heat flow from the region of the insulator, which is situated at the height of the first section of the center electrode, takes place via the center electrode. However, between the second section of the center electrode and the insulator a gap is provided, which greatly limits the heat flow. In order to avoid overheating of the front region of the insulator, the front section has a geometry in which the quotient of outer surface A and annular surface R is less than 4.0, particularly less than 3.1 mm. Since the heat absorption of the front section of the insulator takes place-via outer surface A, and a greater outer surface means a greater heat absorption, and since the heat flows via annular surface R to the connecting end of the spark plug, and since the heat is dissipated better over a larger annular surface R, a geometry is advantageously selected in which the outer surface A is comparatively small and annular surface R is comparatively large. An especially good heat dissipation was achievable using spark plugs whose front section has a ratio A/R in the range of 2.0 to 2.9, particularly 2.5.

The spark plug has an electrode spacing r between the center electrode and the first ground electrode, and an electrode spacing s between the center electrode and the second ground electrode. Upon the application of a voltage, a spark gap may form both between the first ground electrode and the center electrode, and between the second ground electrode and the center electrode. Advantageously, the electrode spacings are designed so that, in the case of an insulator that is not carbon-fouled or only a little so, the predominant number of spark gaps form between the first ground electrode and the center electrode, since this spark gap leads to an optimal ignition of the air/fuel mixture, and in the case of a more carbon-fouled insulator, the proportion of the spark discharges between the second ground electrode and the center electrode rises to such an extent that the carbon-fouling of the insulator is at least partially burnt off by the spark discharges. For this, spark plugs have proven to be suitable for which the quotient s/r is in the range of 1 to 2.5, particularly in the range of 1.3 to 1.8, and/or for which the difference s−r is in the range of 0 mm to 1 mm, especially in the range of 0.4 mm to 0.8 mm. The distance of the first ground electrode from the center electrode is here and below understood to mean the axial distance of the first ground electrode from the end face of the center electrode. The second ground electrode has an end section facing the center electrode. The distance of the second ground electrode from the center electrode should be understood to mean the shortest radial distance of the end section of the second ground electrode from the region of the center electrode which lies (with respect to the longitudinal axis of the insulator) at the height of the end section of the second ground electrode.

To avoid sparks digging in, the insulator advantageously has a conical region at the inside edge of its end face.

Preventing sparks from digging in is particularly effectively done if the conical region is at an angle to the longitudinal axis of the insulator of 20 to 40 degrees, especially 30 degrees, and if the conical region has an extension m in the radial direction of 0.2 mm to 0.4 mm, particularly 0.3 mm, and has an extension n in the axial direction of 0.4 mm to 0.8 mm, particularly 0.6 mm.

It is of advantage if the edge of the end section of the second ground electrode, that faces away from the combustion chamber, is positioned flush with the end face of the insulator. By such an arrangement, in which the end section of the second ground electrode is not situated directly opposite the outer lateral surface of the insulator, the formation of soot bridges between ground electrode and insulator is effectively prevented. In a particularly advantageous manner, the outer edge of the insulator's end face is rounded off at a radius of about 0.3 mm, since because of this radius, the distance between the edge at the connecting end of the end section of the second ground electrode from the insulator is increased, and since at this geometry, the tendency towards sliding spark discharge is not reduced, or at least not substantially reduced by the application of the rounding off of the outer edge of the insulator.

BRIEF DESCRIPTION OF THE DRAWINGS

Exemplary embodiments of the present invention are shown in the FIGURES and are explained in detail below.

DETAILED DESCRIPTION OF EXAMPLE EMBODIMENTS

Figure 1:
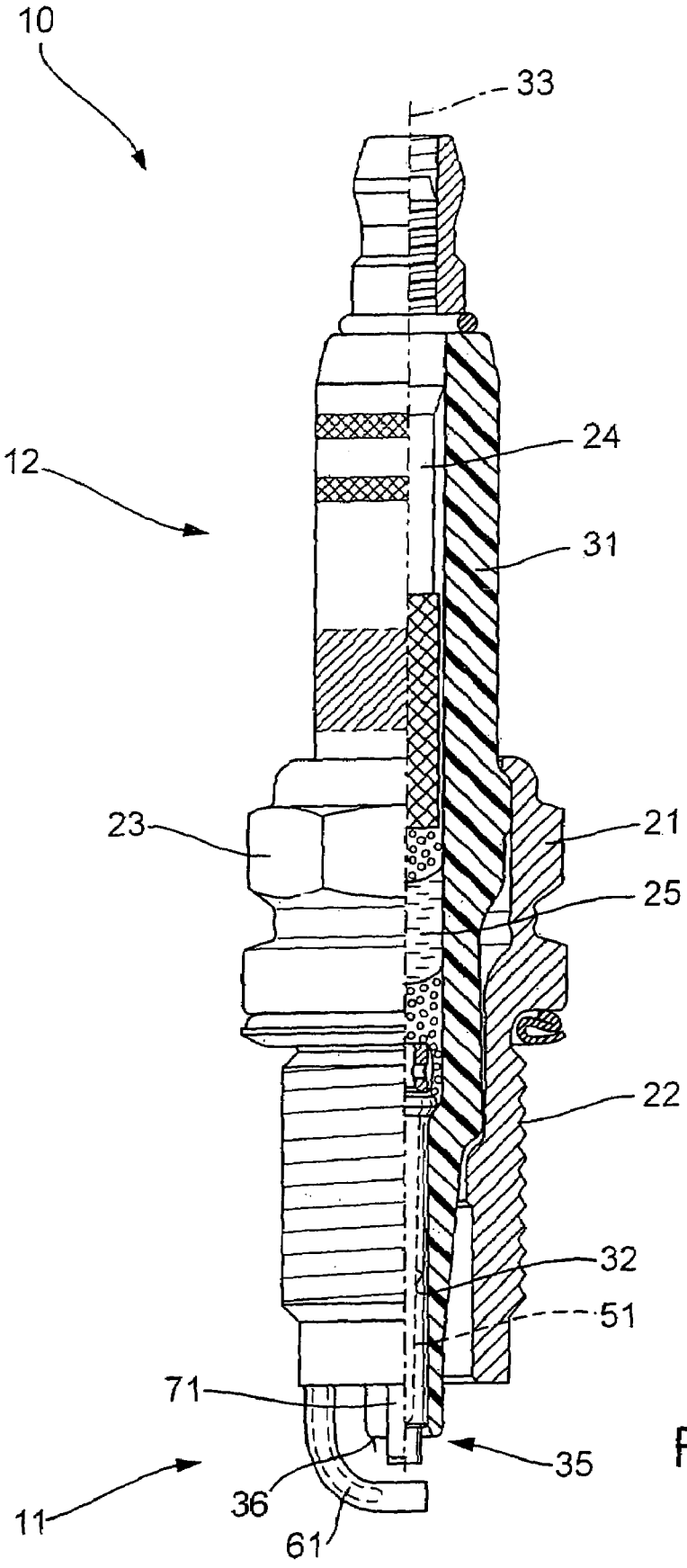
FIG. 1 shows, as the first exemplary embodiment of the present invention, a spark plug according to the present invention in a partial section.
Figure 2:
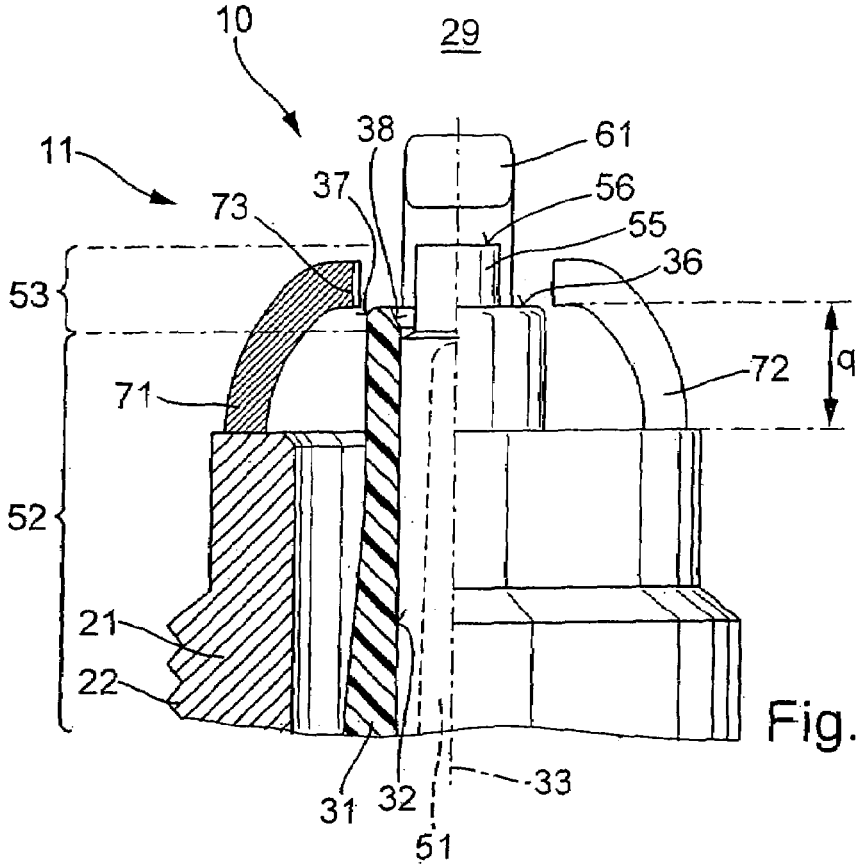
FIG. 2 shows a detailed view of the end section of the first exemplary embodiment at the combustion chamber end.
Figure 3:
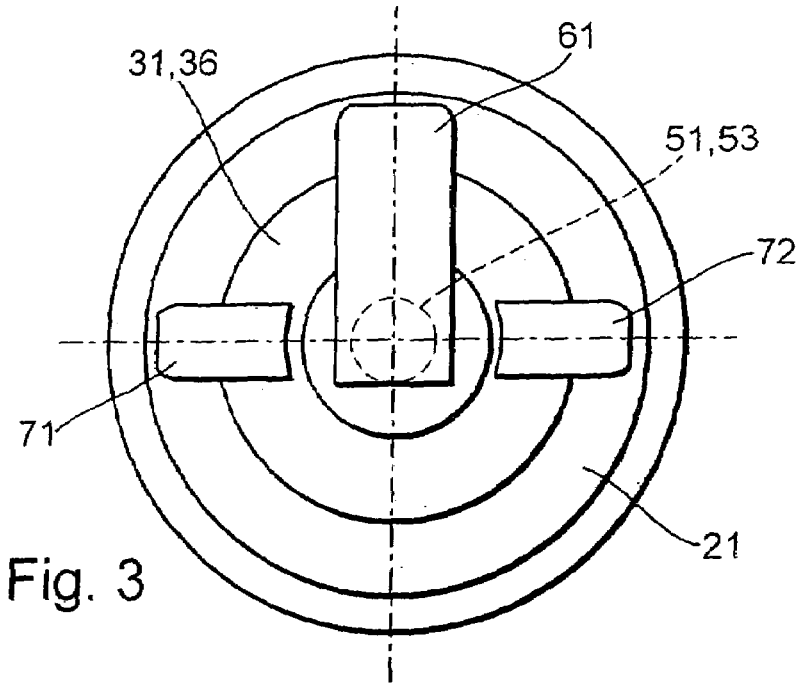
FIG. 3 shows a top view onto the end section at the combustion chamber end, according to FIG. 2.

FIGS. 1 through 4 show, as a first exemplary embodiment of the present invention, a spark plug 10 having an end 11 at the combustion chamber end, and a connecting end 12. Spark plug 10 includes a metallic housing 21, that is provided with a screw thread 22 and a hexagon drive 23. Spark plug 10 is screwed into a mating thread in the cylinder head of an internal combustion engine, using a tool that engages hexagon drive 23, so that spark plug 10 projects with its end 11, that is at the combustion chamber end, into a combustion chamber 29 of a cylinder of the internal combustion engine.

A ceramic insulator 31 is fixed gas-tight in housing 21. Insulator 31 has a longitudinal bore 32 having an axis of symmetry which forms longitudinal axis 33 of insulator 31, and therewith of spark plug 10. In longitudinal bore 32 of insulator 31, at the connecting end, a connecting bolt 24, and at the combustion chamber end, a central electrode 51 have been applied. Connecting bolt 24 and center electrode 51 are electrically connected by a resistor element 25, that is also situated in longitudinal bore 32, which, when a high voltage is applied to the connecting bolt 24 acts current-limiting. Resistor element 25 includes a resistor panat and two contact panats, the resistor panat being electrically connected by one contact panat in each case to connecting bolt 24 and to center electrode 51.

At combustion chamber end 11 of spark plug 10, insulator 31 projects out from housing 21, and has an end face 36 facing combustion chamber 29. The length q denotes the projection of insulator 31 beyond the combustion chamber end of housing 21. Center electrode 51 extends beyond end face 36 of insulator 31 into combustion chamber 29.

At housing 21 are fixed first ground electrode 61, a second ground electrode 71 and a third ground electrode 72. First ground electrode 61 is formed as a top electrode which, starting from housing 21 first extends in a direction parallel to longitudinal axis 33 of spark plug 10 and bends 90 degrees towards center electrode 51 in such a way that first ground electrode 61 extends past center electrode 51, that is, right into the region of longitudinal axis 33 of spark plug 10. Second and third ground electrodes 71, 72, similar to first ground electrode 61, have a bend all the way to center electrode 51, second and third ground electrodes 71, 72 being laterally placed electrodes whose end section 73 are situated laterally next to center electrode 51, so that end section 73 is situated opposite to the lateral surface of the part of center electrode 51 that juts out of insulator 31.

On account of the geometry of ground electrodes 61, 71, 72, when a high voltage is applied to connecting bolt 24, two different types of spark gaps may form, namely, on the one hand, between first ground electrode 61 and center electrode 51 a spark air gap, which generally runs parallel to longitudinal axis 33 of insulator 31, and on the other hand, an air surface gap, which runs from the second or third ground electrode 71, 72 to the outer edge of insulator 31 (air spark), via end face 36 of insulator 31 (surface gap) and from the inner edge of insulator 31 to center electrode 51 (air spark). An ignition spark running along the spark air gap effects an optimal ignition of the air/fuel mixture, whereas, via an ignition spark sliding over insulator 31, deposits on insulator 31, especially soot deposits are burnt off.

The outer lateral surface of insulator 31 is cylindrical on the combustion chamber end, and goes over into a conically shaped region in the connecting end direction. Longitudinal bore 32 of insulator 31 has a predominantly constant diameter in the region of center electrode 51. The outer edge of end face 36 of insulator 31 is designed to be rounded off 37, having a radius of 0.3 mm. At the inner edge of end face 36 of insulator 31 a bevel is provided, i.e. a conical region 38.

Center electrode 51 has a cylindrical first section 52, in which the gap distance between center electrode 51 and insulator 31 is about 0.035 mm. A second section 53, having a smaller diameter, borders on first section 52 at the combustion chamber end. The transition between first section 52 and second section 53 is formed by a short conical section (or alternatively by a shoulder). Second section 53 (except in a partial region of the short conical section) has a distance of at least 0.35 mm from the inner wall (longitudinal bore 32) of insulator 31. On account of the conically widening inner edge 38 of end face 36 of insulator 31, the distance between center electrode 51 and insulator 31 at the height of end face 36 of the insulator amounts to 0.65 mm.

Figure 4:
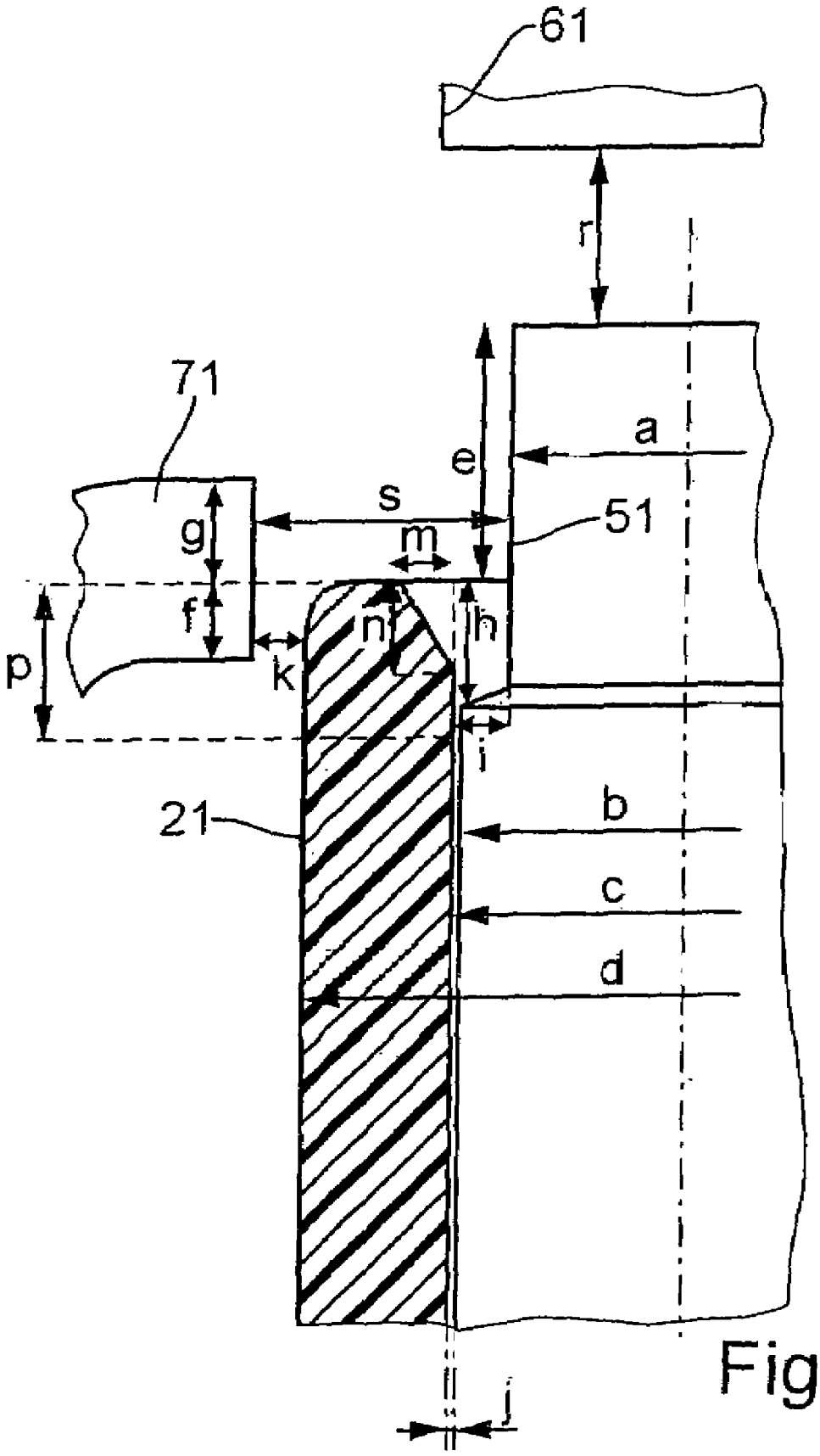
FIG. 4 shows an additional detailed view of the end section of the first exemplary embodiment at the combustion chamber end.

In FIG. 4, various dimensions of end 11 of spark plug 10 at the combustion chamber end are shown, which will be explained below. The diameter of second section 53 of center electrode 51 is marked a, b designates the diameter of first section 52 of the center electrode, c designates the diameter of longitudinal bore 32, i.e., the internal diameter of insulator 31, d designates the outside diameter of the cylindrically formed end section of insulator 31 at the combustion chamber end, e designates the axial length (i.e., the length in the direction of longitudinal axis 33 of insulator 31) of the part of center electrode 51 that projects beyond end face 36 of insulator 31 (i.e., the projection of center electrode 51 with respect to the longitudinal axis of spark plug 10), f designates the axial distance between the side of end section 73, of second or third ground electrode 71, 72 that is facing away from combustion chamber 29, from end face 36 of insulator 31, g designates the axial distance between the side of end section 73 of second or third ground electrode 71, 72, that faces combustion chamber 29, and end face 36 of insulator 31, h designates the axial distance of the region of center electrode 51 which has a distance of at least 0.15 mm from longitudinal bore 32 of insulator 31 from end face 36 of insulator 31, i designates the smallest distance of the cylindrical region, situated within insulator 31, of second section 53 of center electrode 51 from longitudinal bore 32 of insulator 31, j designates the distance between first section 52 of center electrode 51 from longitudinal bore 32 of insulator 31, k designates the radial distance between end section 73 of second or third ground electrode 71, 72 and the outer surface of insulator 31 at the height of respective end section 73, m designates the radial extension of conical region 38 of insulator 31, i.e., half the difference between the diameter of the inner edge of end face 36 of insulator 31 and the inside diameter of the cylindrical region of insulator 31 (at the height of first section 52 of center electrode 51), n designates the axial extension of conical region 38 of insulator 31, i.e. the distance of the region in which longitudinal bore 32 of insulator 31 goes over from a cylindrical to a conical shape, to the plane in which end face 36 of insulator 31 lies, q designates the axial length of the section of the insulator that projects beyond housing 12 at the combustion chamber end, r designates the distance between first ground electrode 61 and end face 56 of center electrode 51, and s designates the distance between end section 73 of second or third ground electrode 71, 72 from the lateral surface of the cylindrical region of second section 53 of center electrode 51.

The exemplary embodiment according to FIGS. 1 to 4 has the following dimensions:

a: 2.1 mm b: 2.73 mm c: 2.8 mm d: 4.5 mm e: 1.5 mm f: $|f| \leqq 0.25$ mm, especially f=0 mm g: 1.05 mm h: 0.7 mm i: 0.35 mm j: 0.035 mm k: 0.35 mm m: 0.3 mm n: 0.6 mm q: 2.5 mm r: 0.9 mm s: 1.5 mm Thus, the outer surface A of front section 35 of insulator 31 is approximately 24.1 $mm^2$, volume V of front section 35 amounts to about 6.1 $mm^3$, and annular surface R amounts to about 9.7 $mm^2$. The ratio V/A thus comes out to about 0.25 mm, the ratio A/R is about 2.5. The difference d−c in front region 35 of insulator 31 is at most 1.7 mm, the length p of front region 35 being given optionally by the length q of the projection of insulator 31 beyond housing 21 or by the height h of the gap between second section 53 of center electrode 51 and insulator 31.

Figure 5:
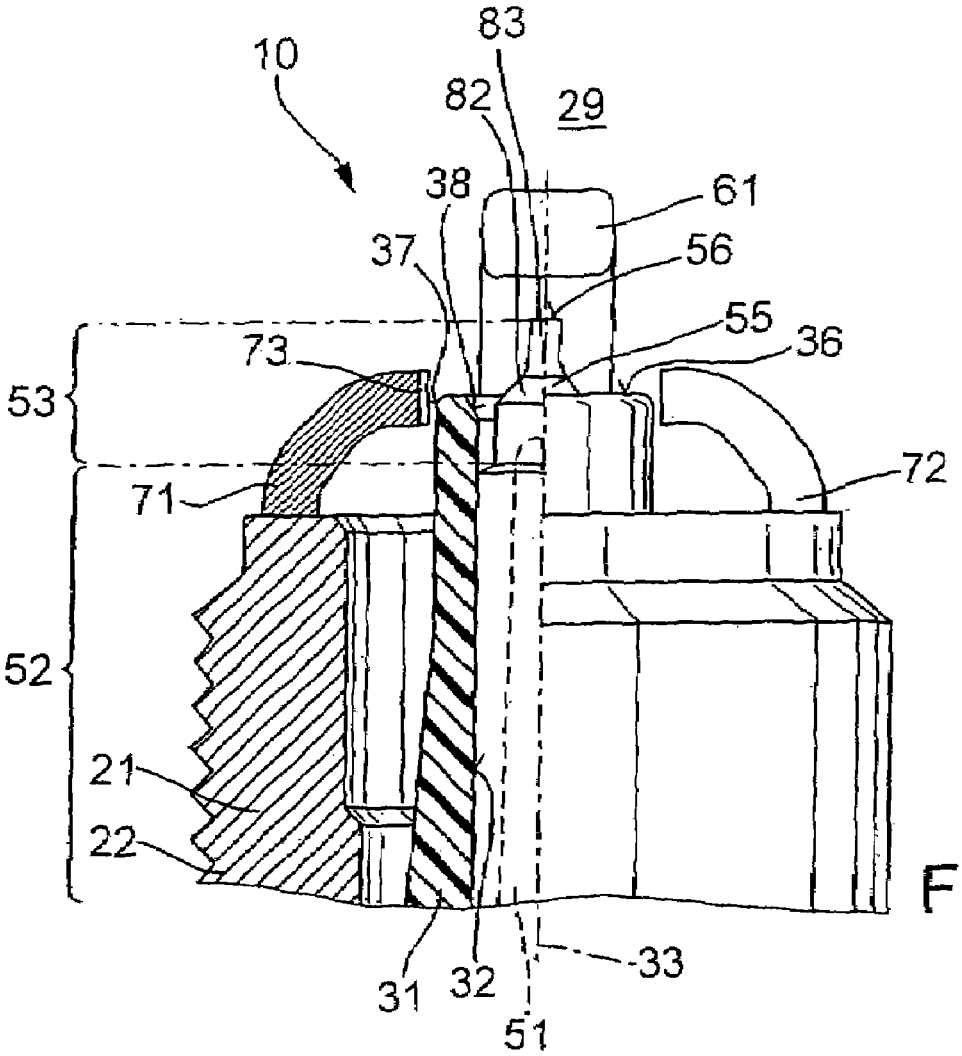
FIG. 5 shows the end section of a second exemplary embodiment of a spark plug according to the present invention, at the combustion chamber end.

FIG. 5 shows a second exemplary embodiment of the present invention, which differs from the first exemplary embodiment essentially by the design of center electrode 51 and second and third ground electrodes 71, 72. Elements that correspond to each other are marked in the second exemplary embodiment using the same reference numerals as in the first exemplary embodiment according to FIGS. 1 through 4.

Center electrode 51 of spark plug 10 according to the second exemplary embodiment has a second section 53, which has a cylindrical first region 81, a conically tapering second region 82 and a third region formed as a noble metal tip 83. First region 81 of second section 53 is adjacent to first section 52 of center electrode 51, the transition between first and second section 52, 53 being formed, similarly to the first exemplary embodiment, by a short conical section. First region 81 of second section 53 of center electrode 51 goes over into second region 82, to which noble metal tip 83 is adjacent using end face 56 that faces first ground electrode 61, which has a diameter of 0.6 mm.

The dimensions of the second exemplary embodiment differ from the dimensions of the first exemplary embodiment in the following values:

f: 0.55 mm g: 0.50 mm h: 1.3 mm q: 3.0 mm

Diameter a of second section 52 of center electrode 51 is understood to mean the diameter of first region 81 of second section 52; first region 81 forms the major part of the part of second section 52 of center electrode that is situated within insulator 31. Distance s designates the distance between end section 73 of second or third ground electrodes 71, 72 from the lateral surface of first region 81 of second section 53 of center electrode 51, in which the air surface gap, that forms between center electrode 51 and second or third ground electrode 71, 72 also ends. Distance r designates the distance between first ground electrode 61 and end face 56 of noble metal tip 83 of center electrode 51. For outer surface A of front section 35 of insulator 31, a value of approximately 37.9 $mm^2$ is derived, volume V of front section 35 amounts to about 11.9 $mm^3$, and annular surface R amounts to about 9.7 $mm^2$, as in the first exemplary embodiment. Ratio V/A comes to about 0.21 mm, and the ration A/R is approximately 3.9.

What is claimed is:

1. A spark plug having a combustion chamber end and a connecting end, comprising:

a housing;

an insulator situated in the housing, the insulator having a longitudinal bore with a longitudinal axis;

a center electrode situated in the longitudinal bore of the insulator;

a first ground electrode which extends into a region of the longitudinal axis of the insulator; and a second ground electrode situated at a distance from the longitudinal axis of the insulator laterally next to the center electrode, the insulator having a front section facing the first ground electrode, which has an end face;

wherein the insulator has an outside diameter d and an inside diameter c, a difference d−c between the outside diameter d and the inside diameter c being in a range of 1.6 mm to 1.8 mm in the front section of the insulator.

2. The spark plug as recited in claim 1, wherein d−c is 1.7 mm.

3. The spark plug as recited in claim 1, wherein the inside diameter c of the insulator is greater than 2.5 mm.

4. The spark plug as recited in claim 1, wherein the inside diameter c of the insulator is in a range of 2.6 mm to 3.0 mm.

5. The spark plug as recited in claim 1, wherein the front section of the insulator has a volume V, an outer surface A, and a ring surface R that lies within the insulator and closes the front section of the insulator on a side facing away from the first ground electrode.

6. The spark plug as recited in claim 5, wherein a quotient V/A of the volume V and the outer surface A is less than 0.33 mm.

7. The spark plug as recited in claim 6, wherein V/A is in a range of 0.20 mm to 0.32 mm.

8. The spark plug as recited in claim 6, wherein V/A is in a range of 0.23 mm to 0.28 mm.

9. The spark plug as recited in claim 8, wherein V/A is 0.25 mm.

10. The spark plug as recited in claim 5, wherein the quotient A/R of the outer surface A and the ring surface R, is less than 4.0.

11. The spark plug as recited in claim 10, wherein the quotient A/R of the outer surface A and the ring surface R is less than 3.1.

12. The spark plug as recited in claim 10, wherein A/R is in the range of 2.0 to 2.9.

13. The spark plug as recited in claim 12, wherein A/R is 2.5.

14. The spark plug as recited in claim 1, wherein the front section extends, starting from the end face of the insulator, in a direction of the connecting end of the spark plug, and has a length p in a direction of the longitudinal axis of the insulator.

15. The spark plug as recited in claim 14, wherein the length p is given by an axial length q of a section of the insulator that projects from the housing.

16. The spark plug as recited in claim 15, wherein p is in a range of 2 mm to 3.5 mm.

17. The spark plug as recited in claim 15, wherein p is in a range of 2.5 mm to 3 mm.

18. The spark plug as recited in claim 14, wherein the length p of the front region of the insulator is given by an axial extension h of the region of the second section of the center electrode that is situated within the insulator.

19. The spark plug as recited in claim 18, wherein an edge of the end section of the second ground electrode, that faces away from the combustion chamber, is positioned flush with the end face of the insulator.

20. The spark plug as recited in claim 1, wherein a first section of the center electrode is at a radial distance from the longitudinal bore of the insulator of less than 0.15 mm, and a second section of the center electrode is at a radial distance from the longitudinal bore of the insulator of at least 0.15 mm.

21. The spark plug as recited in claim 20, wherein a predominant part of the second section of the center electrode is at a radial distance from the longitudinal bore of the insulator of at least 0.3 mm.

22. The spark plug as recited in claim 20, wherein the second section of the center electrode is provided on a side facing the first ground electrode.

23. The spark plug as recited in claim 20, wherein the second section of the center electrode is at least to a great extent cylindrical, an end face of the center electrode facing the first ground electrode is formed by a surface area of the cylindrical second section of the center electrode.

24. The spark plug as recited in claim 20, wherein an axial extension h of a region situated within the insulator of the second section of the center electrode is in a range of 0.3 mm to 2.0 mm, the axial extension being an extension in the direction of the longitudinal axis of the insulator.

25. The spark plug as recited in claim 24, wherein the axial extension is in a range of 0.5 mm to 1.4 mm.

26. The spark plug according to claim 25, wherein the axial extension h is 0.7 mm.

27. The spark plug as recited in claim 20, wherein the second ground electrode has an end section which, with respect to the longitudinal axis of the insulator, is situated laterally next to the second section of the center electrode.

28. The spark plug as recited in claim 1, wherein the second ground electrode has an end section facing the center electrode, and the insulator has an end face facing the first ground electrode, and wherein an axial extension h of a region of a section of the center electrode that is situated within the insulator is greater than a distance f, the distance f being an axial distance between a side of an end section of the second ground electrode facing away from the first ground electrode and the end face of the insulator, the axial distance being a distance in a direction of the longitudinal axis of the insulator.

29. The spark plug as recited in claim 28, wherein $f \leqq 0.25$ mm.

30. The spark plug as recited in claim 29, wherein f=0 mm.

31. The spark plug as recited in claim 1, wherein the center electrode has an electrode spacing r from the first ground electrode and an electrode spacing s from the second ground electrode.

32. The spark plug as recited in claim 31, wherein a quotient s/r is in the range of 1 to 2.5.

33. The spark plug as recited in claim 32, wherein s/r is in a range of 1.3 to 1.8.

34. The spark plug as recited in claim 32, wherein s/r is 1.5.

35. The spark plug as recited in claim 31, wherein a difference s−r is in a range of 0 mm to 1 mm.

36. The spark plug as recited in claim 35, wherein the difference s−r is in a range of 0.4 to 0.8 mm.

37. The spark plug as recited in claim 36, wherein the difference s−r is 0.6 mm.

38. The spark plug as recited in claim 31, wherein at least one of: i) the electrode spacing r between the center electrode and the first ground electrode is in the range of 0.7 mm to 1.3 mm, and ii) the electrode spacing s between the center electrode and the second ground electrode is in a range of 1.2 mm to 1.8 mm.

39. The spark plug as recited in claim 38, wherein the electrode space r is in a range of 0.8 mm to 1.1 mm.

40. The spark plug as recited in claim 39, wherein the electrode spacing r is 0.9 mm.

41. The spark plug as recited in claim 38, wherein the electrode spacing s is in a range of 1.4 mm to 1.6 mm.

42. The spark plug as recited in claim 1, wherein an end face of the insulator that faces the first ground electrode has an outer edge and an inner edge.

43. The spark plug as recited in claim 42, wherein at least one of the outer edge and the inner edge of the end face of the insulator has a radius that is in a range between 0.2 mm and 0.4 mm.

44. The spark plug as recited in claim 42, wherein at least one of the outer edge and an inner edge of the end face of the insulator has a radius of 0.3 mm.

45. The spark plug as recited in claim 42, wherein the insulator has a conical region, in a direction towards the end face of the insulator.

46. The spark plug as recited in claim 45, wherein the outer edge of the end face of the insulator has a radius that is in the range between 0.2 mm and 0.4 mm.

47. The spark plug as recited in claim 46, wherein the outer edge of the end face of the insulator has a radius of 0.3 mm.

48. A spark plug having a combustion chamber end and a connecting end, comprising:

a housing;

an insulator situated in the housing, the insulator having a longitudinal bore with a longitudinal axis;

a center electrode situated in the longitudinal bore of the insulator;

a first ground electrode which extends into a region of the longitudinal axis of the insulator; and a second ground electrode situated at a distance from the longitudinal axis of the insulator laterally next to the center electrode, the insulator having a front section facing the first ground electrode, which has an end face;

wherein the insulator has an outside diameter d and an inside diameter c, a difference d−c between the outside diameter d and the inside diameter c being not greater than 1.9 mm in the front section of the insulator and the inside diameter c of the insulator is 2.8 mm.

49. A spark plug having a combustion chamber end and a connecting end, comprising:

a housing;

an insulator situated in the housing, the insulator having a longitudinal bore with a longitudinal axis;

a center electrode situated in the longitudinal bore of the insulator;

a first ground electrode which extends into a region of the longitudinal axis of the insulator; and a second ground electrode situated at a distance from the longitudinal axis of the insulator laterally next to the center electrode, the insulator having a front section facing the first ground electrode, which has an end face;

wherein the insulator has an outside diameter d and an inside diameter c, a difference d−c between the outside diameter d and the inside diameter c being not greater than 1.9 mm in the front section of the insulator and the outside diameter d of the insulator is in a range of 4.3 mm to 4.7 mm.

50. The spark plug as recited in claim 49, wherein the outside diameter d of the insulator is in a range of 4.4 mm to 4.6 mm.

51. The spark plug as recited in claim 50, wherein the outside diameter d of the insulator is 4.5 mm.

52. A spark plug having a combustion chamber end and a connecting end, comprising:

a housing;

an insulator situated in the housing, the insulator having a longitudinal bore with a longitudinal axis;

a center electrode situated in the longitudinal bore of the insulator;

a first ground electrode which extends into a region of the longitudinal axis of the insulator; and a second ground electrode situated at a distance from the longitudinal axis of the insulator laterally next to the center electrode, the insulator having a front section facing the first ground electrode, which has an end face;

wherein the insulator has an outside diameter d and an inside diameter c, a difference d−c between the outside diameter d and the inside diameter c being not greater than 1.9 mm in the front section of the insulator;

wherein the center electrode has an electrode spacing r from the first ground electrode and an electrode spacing s from the second ground electrode; and wherein the electrode spacing s between the center electrode and the second ground electrode is 1.5 mm.

53. A spark plug having a combustion chamber end and a connecting end, comprising:

a housing;

an insulator situated in the housing, the insulator having a longitudinal bore with a longitudinal axis;

a center electrode situated in the longitudinal bore of the insulator;

a first ground electrode which extends into a region of the longitudinal axis of the insulator; and a second ground electrode situated at a distance from the longitudinal axis of the insulator laterally next to the center electrode, the insulator having a front section facing the first ground electrode, which has an end face;

wherein the insulator has an outside diameter d and an inside diameter c, a difference d−c between the outside diameter d and the inside diameter c being not greater than 1.9 mm in the front section of the insulator;

wherein an end face of the insulator that faces the first ground electrode has an outer edge and an inner edge;

wherein the insulator has a conical region, in a direction towards the end face of the insulator; and wherein the conical region is provided at the inner edge of the end face of the insulator, and the conical region has an angle in a range of 20 to 40 degrees to the longitudinal axis of the insulator.

54. The spark plug as recited in claim 53, wherein the angle is 30 degrees.

55. A spark plug having a combustion chamber end and a connecting end, comprising:

a housing;

an insulator situated in the housing, the insulator having a longitudinal bore with a longitudinal axis;

a center electrode situated in the longitudinal bore of the insulator;

a first ground electrode which extends into a region of the longitudinal axis of the insulator; and a second ground electrode situated at a distance from the longitudinal axis of the insulator laterally next to the center electrode, the insulator having a front section facing the first ground electrode, which has an end face;

wherein the insulator has an outside diameter d and an inside diameter c, a difference d−c between the outside diameter d and the inside diameter c being not greater than 1.9 mm in the front section of the insulator;

wherein an end face of the insulator that faces the first ground electrode has an outer edge and an inner edge;

wherein the insulator has a conical region, in a direction towards the end face of the insulator; and wherein the conical region, in an radial direction, has an extension m of 0.2 mm to 0.4 mm and, in an axial direction, has an extension n of 0.4 mm to 0.8 mm.

56. The spark plug as recited in claim 55, wherein the extension n is 0.3 mm.

57. The spark plug as recited in claim 55, wherein the extension n is 0.6 mm.

* * * * *